US006213129B1

(12) United States Patent
Muldoon

(10) Patent No.: US 6,213,129 B1
(45) Date of Patent: Apr. 10, 2001

(54) CRADLE CAP KIT

(76) Inventor: Tania Muldoon, 64-47 185th St., Fresh Meadows, NY (US) 11365

( * ) Notice: Subject to any disclaimer, the term of this patent is extended or adjusted under 35 U.S.C. 154(b) by 0 days.

(21) Appl. No.: 09/406,700

(22) Filed: Sep. 28, 1999

(51) Int. Cl.[7] ..... A45D 24/16; A45D 24/22; A47L 13/26

(52) U.S. Cl. ..... 132/120; 132/112; 401/139

(58) Field of Search ..... 132/120, 112, 132/113, 114, 115; 401/139, 137, 262

(56) References Cited

U.S. PATENT DOCUMENTS

| | | | | |
|---|---|---|---|---|
| D. 376,910 | * | 12/1996 | Tuchman | D4/114 |
| 2,228,213 | * | 1/1941 | Hillsberry | 132/120 |
| 2,299,296 | * | 10/1942 | Battle | 132/114 |
| 2,515,094 | * | 7/1950 | Price | 132/112 |
| 3,491,777 | * | 1/1970 | Grosbard | 132/120 |
| 4,277,193 | * | 7/1981 | Kraus | 401/39 |
| 4,289,153 | * | 9/1981 | Paccione | 132/120 |
| 4,557,619 | * | 12/1985 | De Vincentis | 401/190 |
| 5,311,887 | * | 5/1994 | Ramsey | 132/114 |

* cited by examiner

*Primary Examiner*—John J. Wilson
*Assistant Examiner*—Robyn Kieu Doan
(74) *Attorney, Agent, or Firm*—Michael I Kroll

(57) ABSTRACT

The present invention 10 discloses a device used to treat cradle cap. The device discloses a contoured handle 20 having a cavity 32 inside for containing liquid 34, e.g., baby oil. Attached to the distal end is a comb member 14 and a hairbrush member 16 having a recessed applicator 28 contained therein which is slidably operated by a switch 18 on the exterior of the device. The handle 20 also has a spray head assembly 36 attached thereto having a spray nozzle 22 and trigger 24 thereon. A storage container 12 is provided for storage of the present invention 10 between uses. Another embodiment discloses the handle 20 having a connection means 54 for connection to a separate member 52 comprising a comb member 14 and a hair brush member 16.

12 Claims, 7 Drawing Sheets

CRADLE CAP KIT

BACKGROUND OF THE INVENTION

1. Field of the Invention

The present invention relates generally to hairbrushes and, more specifically, to a baby care product used to treat a condition in newborns commonly referred to as cradle cap. The present invention incorporates means for applying baby oil to loosen the thick, crusty epidermal layer of the scalp, means for massaging the scalp area and means for removing the scaly skin particles from the scalp using a hairbrush-like device.

The hairbrush-like device has a contoured cylindrical housing conforming to the shape of said device wherein said device can be stored until desired use. Thereby preventing contamination of said device by dust and dirt.

The hairbrush-like device has a fine toothed comb and an oppositely opposed soft bristled hairbrush on the distal end and a handle on the proximal end.

At the proximal end extending away from the handle is a spray attachment capping the handle having fluid connection with a cavity within the handle wherein is stored a quantity of baby oil which can be selectively dispensed onto the scalp of an infant. The cavity within the handle can be accessed for cleaning and refilling by removing the spray attachment.

Further said hairbrush-like device has an extendable retractable applicator housed within a cavity within the device housing at the distal end from said spray attachment. Said applicator can be extended or retracted by means of a slidable member located exteriorly on the housing having connection means with said recessed applicator.

The user of the present invention removes the hairbrush-like device from within the storage container and while holding the infants head in one hand applies a predetermined amount of baby oil using the spray applicator to the infants scalp. The user will then rotate the hairbrush-like device and selectively massage the baby oil into the scalp before removing the loosened skin particles by means of combing and/or brushing the scalp of the infant.

2. Description of the Prior Art

There are other hairbrush applicator devices designed for applying liquids to the head area Typical of these is U.S. Pat. No. 4,090,522 issued to Donley et al. on May 23, 1978.

Another patent was issued to Busch et al. on Sep. 19, 1989 as U.S. Pat. No. 4,867,183. Yet another U.S. Pat. No. 4,938,621 was issued to Pyrozyk on Jul. 3, 1990 and still yet another was issued on Mar. 1, 1994 to McDonald as U.S. Pat. No. 5,289,833.

Another patent was issued to Hogan et al. on Sep. 12, 1995 as U.S. Pat. No. 5,449,006. Yet another U.S. Pat. No. 5,725,130 was issued to Kluge et al. on Mar. 10, 1998. Another was issued to Izhak on May 5, 1998 as U.S. Pat. No. 5,746,531 and still yet another was issued on Nov. 11, 1952 to Gaspari as U.S. Pat. No. 2,617,431.

U.S. Pat. No. 4,090,522

Inventor: Virgil L. Donley et al.

Issued: May 23, 1978

A comb for applying medication to the hair and scalp; the comb being hollow so to contain the medication, and the comb teeth each having a central opening extending to the tooth tip so that as the comb is combed through the hair, the medication is dispensed out of the tip of the teeth and massaged into the scalp.

U.S. Pat. No. 4,867,183

Inventor: Peter Busch et al.

Issued: Sep. 19, 1989

There is disclosed a dispenser for hair treating solution and the like in the form of a comb or brush having a hollow spine and teeth of absorbent material inserted therein in capillary-active communication with treatment solution in a reservoir in the spine, the flow of solution from the spine through the teeth to the hair being dependent solely on the quantity of solution applied to the hair through capillary action. Spacers may also be provided to hold the teeth in spaced relation to the scalp.

U.S. Pat. No. 4,938,621

Inventor: Ronald R. Pyrozyk

Issued: Jul. 3, 1990

A hairbrush and mousse dispensing device comprises a body portion having a top end and a bottom end. The body portion includes a mechanism for connecting the device to a pressurized mousse dispensing cylinder, the mechanism for connecting being adjacent the bottom end. The top end of the body portion has a styling brush including a plurality of bristles or teeth spaced there around. The device includes a mechanism for dispensing the mousse from the device which is disposed between a dispensing tip of the pressurized mousse dispensing cylinder and a dispensing aperture in the body portion. The device further includes a mechanism for providing access to the dispensing tip of the pressurized mousse dispensing cylinder.

U.S. Pat. No. 5,289,833

Inventor: Charles E. McDonald

Issued: Mar. 1, 1994

A device for dispensing and applying chemicals onto hair or other multi-fiber composition, consisting of a deformable container, a comb having a hollow spine in fluid communication with the deformable container, and a separator with a dispenser in fluid communication with the hollow spine of the comb.

U.S. Pat. No. 5,449,006

Inventor: Gary L. Hogan et al.

Issued: Sep. 12, 1995

A hair treatment appliance having improved dispensing capable of multi-faceted operation in the care and treatment of human hair. A body is provided having generally a hollow chamber therein to receive an aerosol container. An opening in a wall of the chamber permits a dispensing valve of the aerosol container residing therein to dispense the contents of the container therethrough. A comb is secured to an end of the body and extends outwardly therefrom, with an optional brush attachment removably secured thereto, while at the opposite end, hair lifters, which are a plurality of spaced apart elongated members, are optionally provided. A cap is generally provided adjacent one end of the hollow body and acts as a closure for the hollow chamber that receives the aerosol container. The aerosol container is actuated by a linear moving trigger secured to the body on the opposite side of the opening.

U.S. Pat. No. 5,725,130

Inventor: Kim C. Kluge et al.

Issued: Mar. 10, 1998

A comb and dispenser unit for grooming hair or fur. The unit includes a reservoir having an outwardly flared base with a flat bottom surface upon which the reservoir can be stably stored. A handle portion is coupled to the reservoir and includes a pliable pump actuator in communication with the reservoir and has comb teeth extending away from the handle portion in planes substantially parallel to a plane defined by preferred actuation of the pump actuator. A nozzle is contained in a nozzle portion coupled to the comb portion for spraying a fluid pumped from the reservoir into the hair or fur being groomed. The nozzle sprays fluid above the engagement points of the comb teeth and the hair or fur.

U.S. Pat. No. 5,746,531

Inventor: Allan Izhak

Issued: May 5, 1998

A hairbrush incorporated with a container that dispenses sprays, liquids, gels or other dispensable materials. The core of the hairbrush and the base of the container are joined end to end. The container forms the handle of the hairbrush. The top of the container has a closure cap, a cap with snap open lid or spray nozzle to dispense the contents of the container.

U.S. Pat. No. 2,617,431

Inventor: Joseph Gaspari

Issued: Nov. 11, 1952

This United States patent discloses an implement particularly adapted for the application of dye or other liquid to the hair of the scalp, and is especially directed to a combination implement including a yieldable container for the liquid, an applicator adapted to receive the liquid ejected therefrom for transfer to the hair for dyeing or otherwise subjecting it to treatment, a comb for arranging the hair to receive the treatment and friction means which aid in controlling the speed of travel of the applicator along the hair strands as well as the arrangement of the hair during the treatment.

While these comb/hairbrush applicators may be suitable for the purposes for which they were designed, they would not be as suitable for the purposes of the present invention, as hereinafter described.

SUMMARY OF THE PRESENT INVENTION

The present invention discloses a device used to treat cradle cap. The device discloses a contoured handle having a cavity inside for containing liquid, e.g., baby oil. Attached to the distal end is a comb member and a hairbrush member having a recessed applicator contained therein which is slidably operated by a switch on the exterior of the device. The handle also has a spray head assembly attached thereto having a spray nozzle and trigger thereon. A storage container is provided for storage of the present invention between uses. Another embodiment discloses the handle having a connection means for connection to a separate member comprising a comb member and a hair brush member.

A primary object of the present invention is to provide means for applying and working into the scalp of newborns an amount of oil without getting it on your hands.

Another object of the present invention is to provide means for applying an amount of baby oil to the scalp area and having a plurality of means for working it into the scalp.

Yet another object of the present invention is to provide a hairbrush-like applicator having a comb element and brush element oppositely opposed each other on one end and having a handle.

Still yet another object of the present invention is to provide a hairbrush-like applicator having a comb element and brush element oppositely opposed each other on one end and a spray nozzle having a trigger communicating with a quantity of liquid contained within the handle;

Yet another object of the present invention is to provide a hairbrush-like applicator having an extendable retractable recessed applicator located between the comb element and the hair brush element within the body of the device.

Another object of the present invention is to provide a hairbrush-like applicator having slidable means for extending and retracting the recessed applicator located within the body of the hairbrush-like applicator.

Additional objects of the present invention will appear as the description proceeds.

The present invention overcomes the shortcomings of the prior art by providing a hairbrush-like applicator for applying baby oil to the scalp area of newborns. The hairbrush-like device has a comb and an oppositely opposed hairbrush on the distal end and a handle on the proximal end. At the proximal end extending away from the handle is a spray attachment capping the handle having fluid connection with a quantity of baby oil contained within the hollow compartment of said handle.

Further said hairbrush-like device has a slidable member for extending an applicator, housed within the hollow cavity of the comb brush end of the hairbrush-like device.

The user of said hairbrush-like device can hold the infants head in one hand while applying a selective amount of baby oil by means of the spray applicator. The user can then rotate the hairbrush-like device within the hand and select either the comb, hairbrush, or concealed applicator to massage the baby oil into the scalp.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
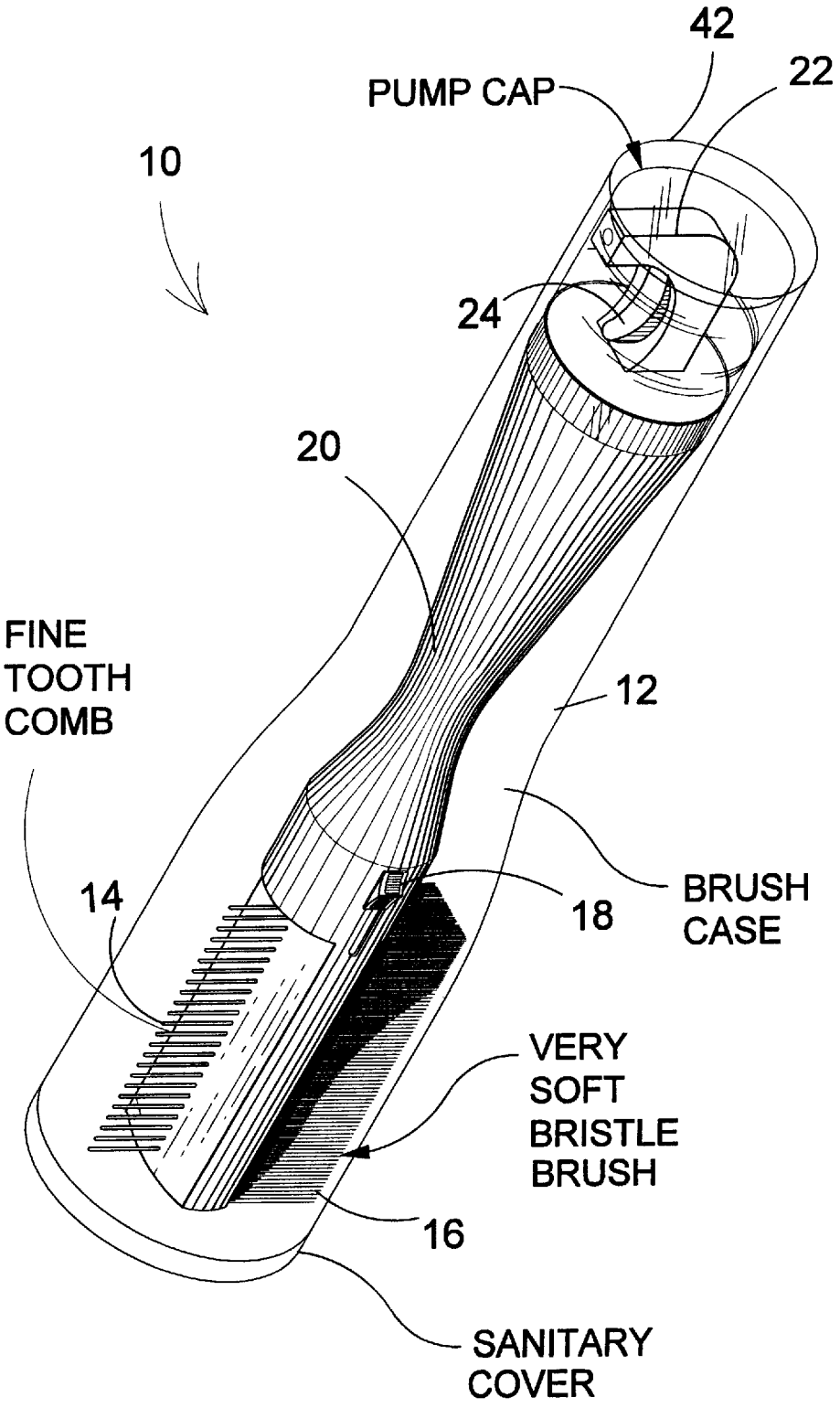
FIG. 1 is a perspective view of the present invention. Shown is a hairbrush-like device contained within a storage container providing means for preventing contamination of said device between uses. The hairbrush-like device has a comb element and an oppositely opposed hairbrush element and a recessed applicator, not shown, having a slide switch for extending and retracting said recessed applicator. Also shown is a handle having a spray nozzle and trigger which communicates with a cavity within the handle wherein is stored a quantity of baby oil which is applied to the scalp area of an infant by means of the spray nozzle trigger. The baby oil is worked into the scalp by means of selective use of the recessed applicator and/or comb element and/or soft brush element.

With regard to reference numerals used, the following numbering is used throughout the drawings:

10 present invention
12 storage container
14 comb element
16 hairbrush element
18 slide switch
20 handle
22 spray nozzle
24 trigger
26 main body element
28 recessed applicator
30 cover
32 cavity
34 liquid
36 spray head attachment
38 means for attaching
40 tube
42 pump cap
44 sanitary cover
46 direction arrow
48 removable handle
50 applicator
52 comb/hairbrush member
54 connection means

DESCRIPTION OF THE PREFERRED EMBODIMENT(S)

In order that the invention may be more fully understood, it will now be described, by way of example, with reference to the accompanying drawings in which FIGS. 1 through 7 illustrate the present invention being a device for treating cradle cap.

Turning to FIG. 1, shown therein is a perspective view of the present invention 10. Shown is a hairbrush-like device 10 contained within a storage container 12 providing means for preventing contamination of the device between uses. The hairbrush like device has a comb element 14 and an oppositely opposed hairbrush element 16 and a recessed applicator (not shown) having a slide switch 18 for extending and retracting the recessed applicator. Also shown is a contoured handle 20 for being held by a user having a spray nozzle 22 and trigger 24 which communicates with a cavity within the handle 20 wherein is stored a quantity of baby oil which is applied to the scalp area of an infant by means of the spray nozzle trigger 24. The baby oil is worked into the scalp by means of selective use of the recessed applicator and/or comb element 14 and/or soft brush element 16. Pump cap 42 is also shown.

Figure 2:
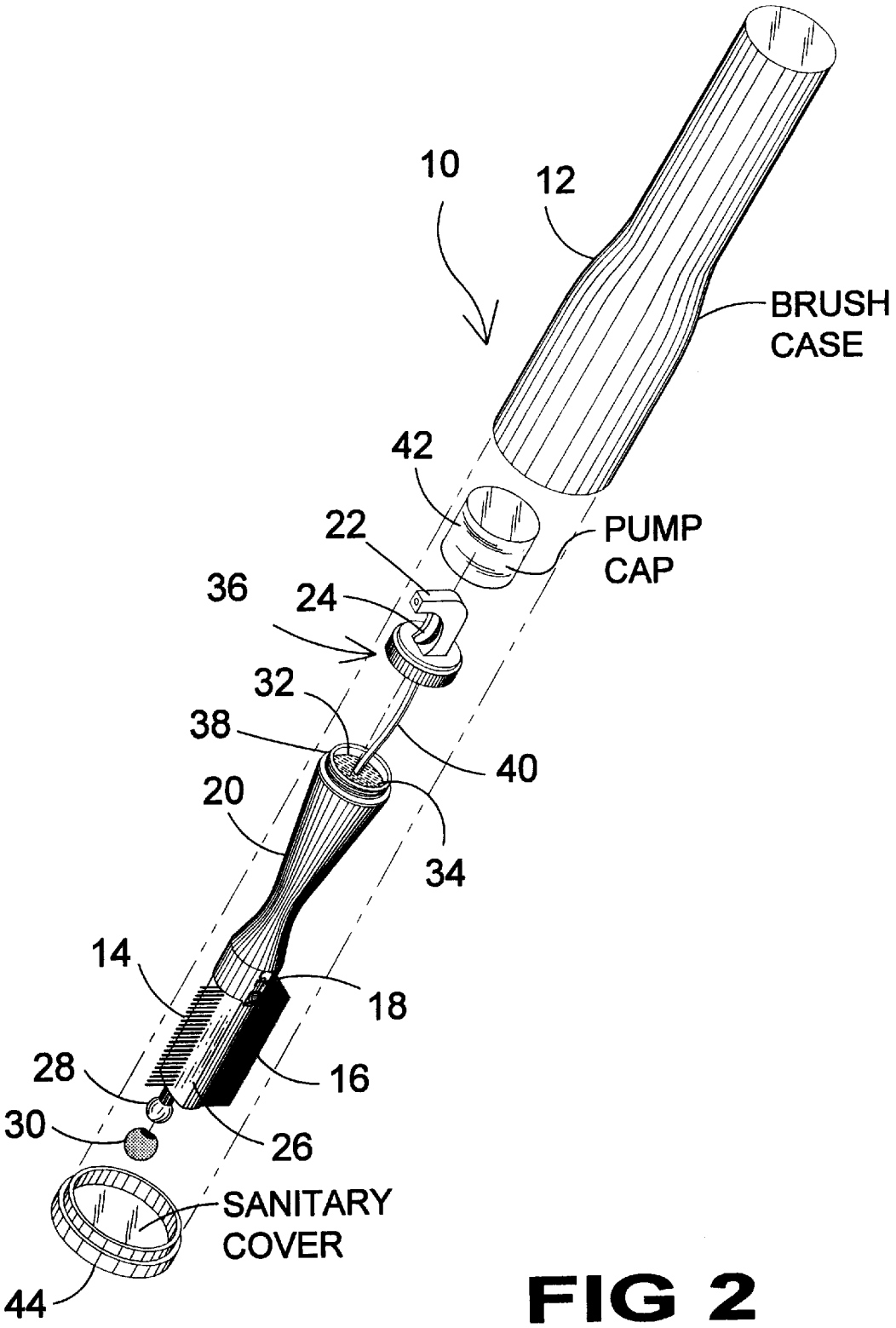
FIG. 2 is an exploded view of the present invention. Shown is a hairbrush-like device contained within a storage container providing means for preventing contamination of said device between uses. Said hairbrush-like device has a main body element encompassing a comb element and oppositely opposed hairbrush element and having a recessed applicator having a slide switch for extending and retracting said recessed applicator. Also shown is the handle having a cavity for the storage of various type of liquids. Further having a spray attachment having means for securing said spray attachment to the handle thereby sealing the handle cavity. Further said spray attachment has a spray nozzle connected to a tube which is inserted into the handle cavity and having a pump trigger for removing the liquid contained within the handle cavity and ejecting the liquid through the spray nozzle.

Turning to FIG. 2, shown therein is an exploded view of the present invention 10. Shown is a hairbrush-like device 10 contained within a storage container 12 providing means for preventing contamination of the device between uses. The hairbrush-like device 10 has a main body element 26 comprising a comb element 14 and oppositely opposed hairbrush element 16 and having a recessed applicator 28 with rubber-like cover 30 having a slide switch 18 for extending and retracting the recessed applicator 28. Also shown is the handle 20 having a first cavity 32 for the storage of various type of liquids 34. Further the spray attachment 36 has means for securing 38 the spray attachment 36 to the handle 20 thereby sealing the handle cavity 32. Further the spray attachment 36 has a spray nozzle 22 connected to a tube or conduit 40 which is inserted into the handle cavity 32 and having a pump trigger 24 for removing the liquid 34 contained within the handle cavity 32 and ejecting the liquid 34 through the spray nozzle 22. Also shown is pump or spray nozzle cap or cover 42 and a sanitary cover 44.

Figure 3:
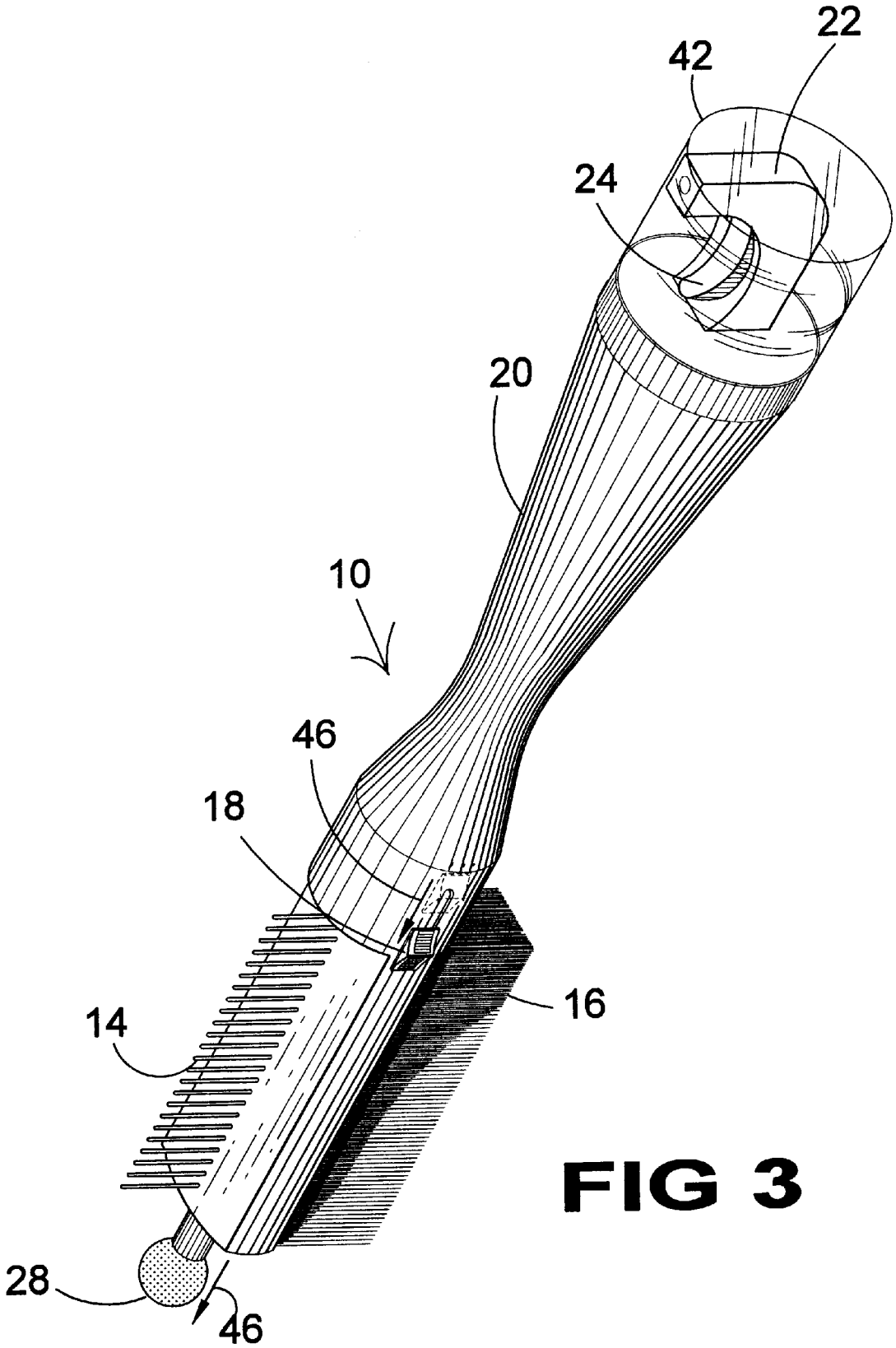
FIG. 3 is a perspective view of the present invention. Shown is a hairbrush-like device contained within a storage container providing means for preventing contamination of said device between uses. The hairbrush-like device has a comb element and an oppositely opposed hairbrush element and a recessed applicator having a slide switch for extending and retracting said recessed applicator. Also shown is a handle having a spray nozzle and trigger which communicates with a cavity within the handle wherein is stored a quantity of baby oil which is applied to the scalp area by means of depressing the spray nozzle trigger. The baby oil is worked into the scalp by means of selective use of the recessed applicator and/or comb element and/or soft brush element.

Turning to FIG. 3, shown therein is a perspective view of the present invention 10. Shown is a hairbrush-like device 10 contained within a storage container (not shown) providing means for preventing contamination of the device between uses. The hairbrush-like device 10 has a comb element 14 and an oppositely opposed hairbrush element 16 and a recessed applicator 28 having a slide switch 18 for extending and retracting the recessed applicator 28 (see direction arrows 46). Also shown is a handle 20 having a spray nozzle 22 and trigger 24 which communicates with a cavity within the handle 20 wherein is stored a quantity of baby oil which is applied to the scalp area by means of depressing the spray nozzle trigger 24. The baby oil is worked into the scalp by means of selective use of the recessed applicator 28 and/or comb element 14 and/or soft brush element 16.

Figure 4:
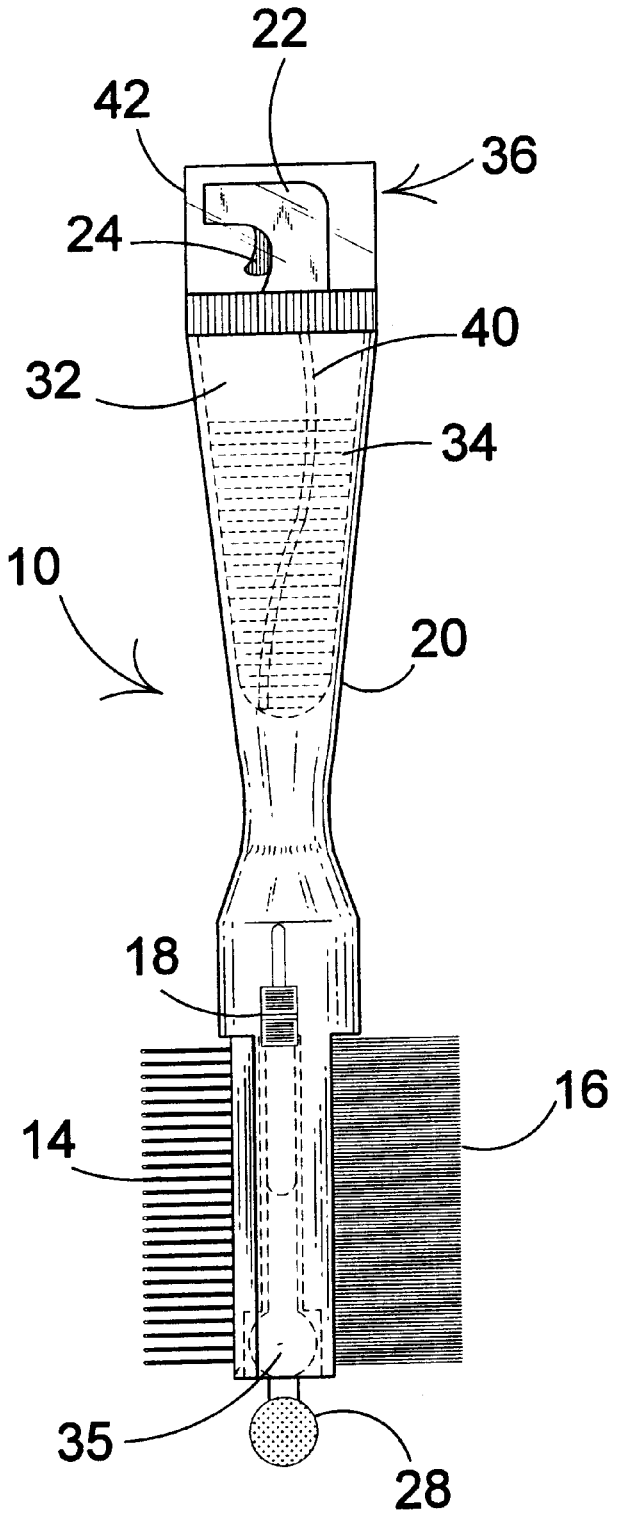
FIG. 4 is a side view of the present invention. Shown is a hairbrush-like device having a comb element and oppositely opposed hairbrush element and having a recessed applicator, shown retracted in outline and extended using the slide switch. Also shown is a handle having a spray nozzle and trigger which communicates by a tube member with a cavity within the handle wherein is stored a quantity of baby oil which is to be applied to the scalp area by means of the spray nozzle trigger. The spray mechanism has a removable cover providing access to the spray mechanism.

Turning to FIG. 4, shown therein is a side view of the present invention 10. Shown is a hairbrush-like device 10 having a comb element 14 and oppositely opposed hairbrush element 16 and having a recessed applicator 28 with a ball-like applicator head 28, shown retracted in outline in a second cavity 35 and having means for being extended using the slide switch 18 being manipulated by a user. Also shown is a handle 20 having a spray nozzle 22 and trigger 24 which communicates by a tube or conduit member 40 within a cavity 32 within the handle 20 wherein is stored a quantity of baby oil 34 which is to be applied to the scalp area by means of the spray nozzle trigger 24. Conduit 40 communicates between cavity 32 and the spray nozzle 22. The spray mechanism 36 has a removable cover 42 providing access to the spray mechanism 36.

Figure 5:
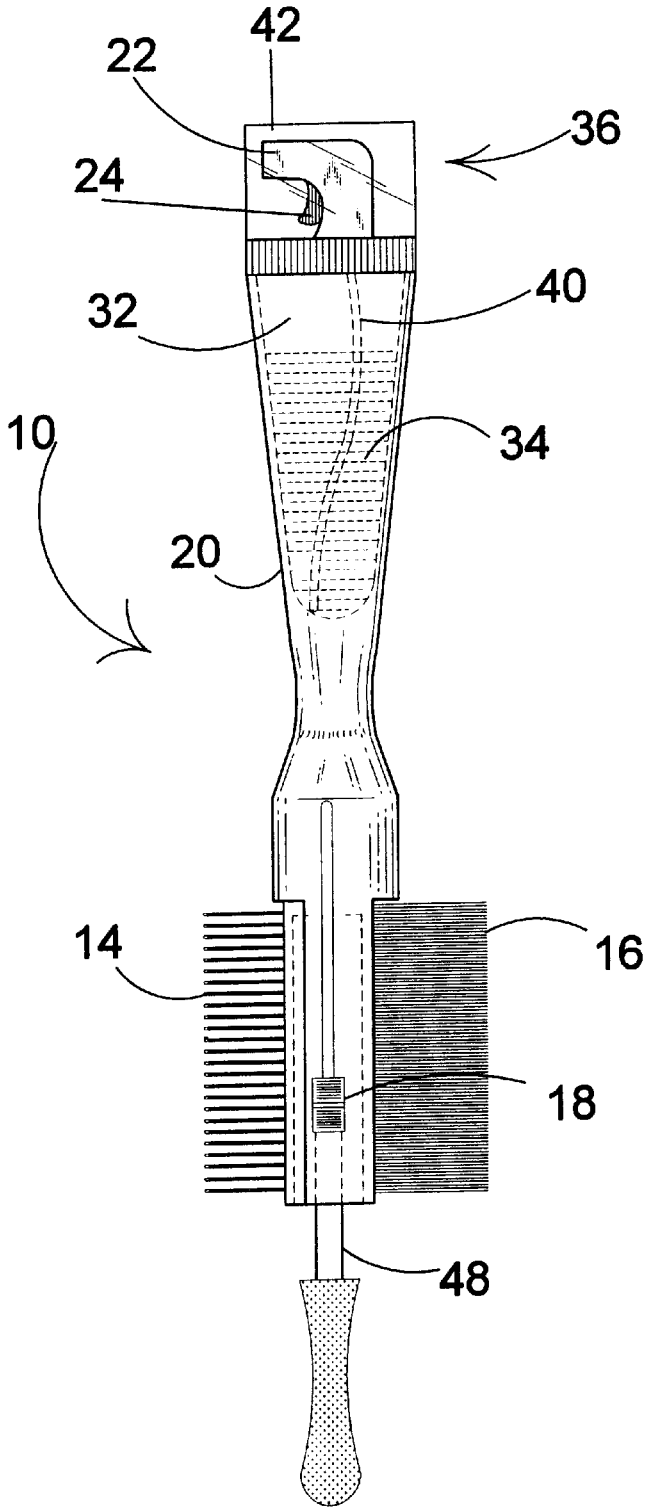
FIG. 5 is a side view of the present invention showing another type of concealed applicator. Shown is a hairbrush-like device having a comb element and oppositely opposed hairbrush element and having a recessed applicator, shown extended using the slide switch. Also shown is a handle having a spray nozzle and trigger which communicates by a tube member with a cavity within the handle wherein is stored a quantity of liquid which is to be applied to the scalp area by means of the spray nozzle trigger. The spray mechanism has a removable cover providing access to the spray mechanism.

Turning to FIG. 5, shown therein is a side view of the present invention 10 showing another type of concealed applicator 48 having an elongated applicator head. Shown is a hairbrush-like device 10 having a comb element 14 and oppositely positioned hairbrush element 16 and having a recessed applicator 48, shown extended using the slide switch 18. Also shown is a handle 20 having a spray nozzle 22 and trigger 24 which communicates by a tube member 40 with a cavity 32 within the handle 20 wherein is stored a quantity of liquid 34 which is to be applied to the scalp area by means of the spray nozzle trigger 24. The spray mechanism 36 has a removable cover 42 providing access to the spray mechanism 36.

Figure 6:
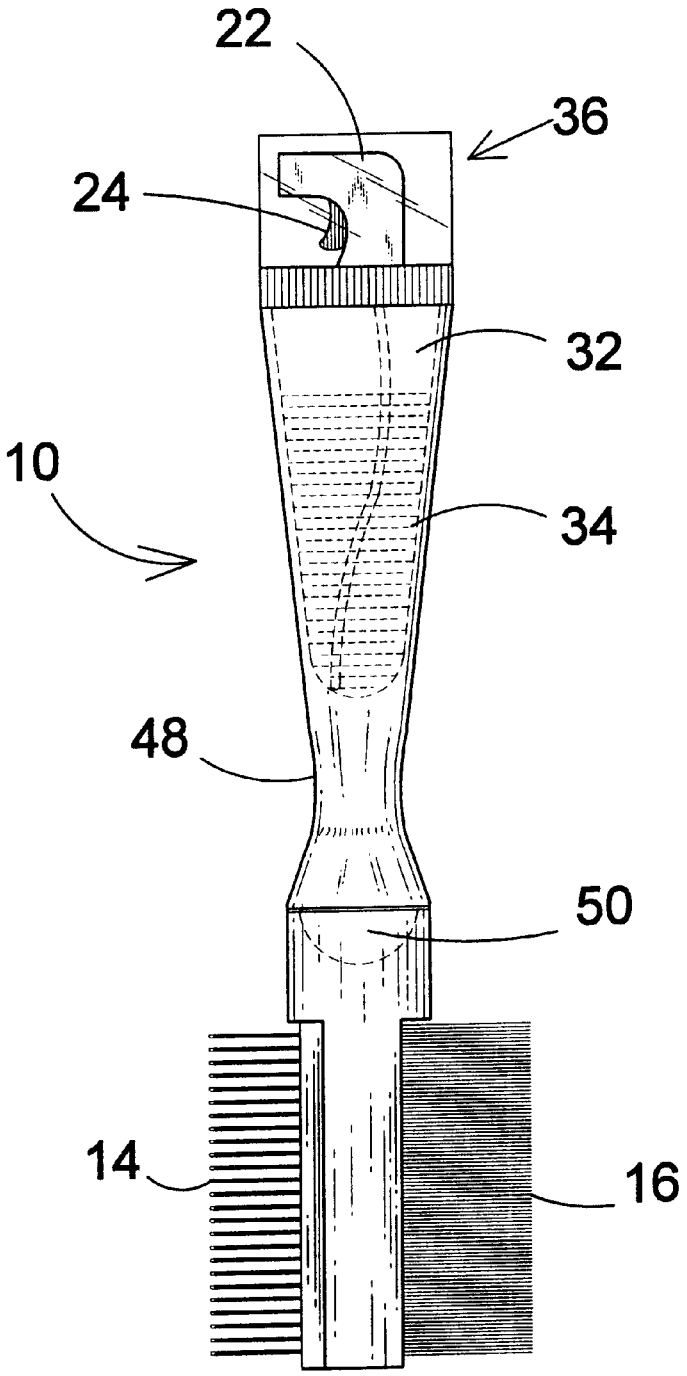
FIG. 6 is a side view of the present invention. Shown is a hairbrush-like device having a comb element and oppositely opposed hairbrush element and having a removable handle. The removable handle has an applicator on one end and a spray attachment of the other. The spray attachment comprises a spray nozzle and trigger which communicates with a cavity within the handle wherein is stored a quantity of liquid which is applied to the scalp area by means of the spray nozzle trigger. The liquid is worked into the scalp by means of selective use of the applicator and/or comb element and/or brush element.

Turning to FIG. 6, shown therein is a side view of the present invention 10. Shown is a hairbrush-like device 10 having a comb element 14 and oppositely positioned hairbrush element 16 and having a removable handle 48. The removable handle 48 has an applicator 50 on one end and a spray attachment 36 on the other. The spray attachment 36 comprises a spray nozzle 22 and trigger 24 which communicates with a cavity 32 within the handle 48 wherein is stored a quantity of liquid 34 which is applied to the scalp area by means of the spray nozzle trigger 24. The liquid 34 is worked into the scalp by means of selective use of the applicator 50 and/or comb element 14 and/or brush element 16.

Figure 7:
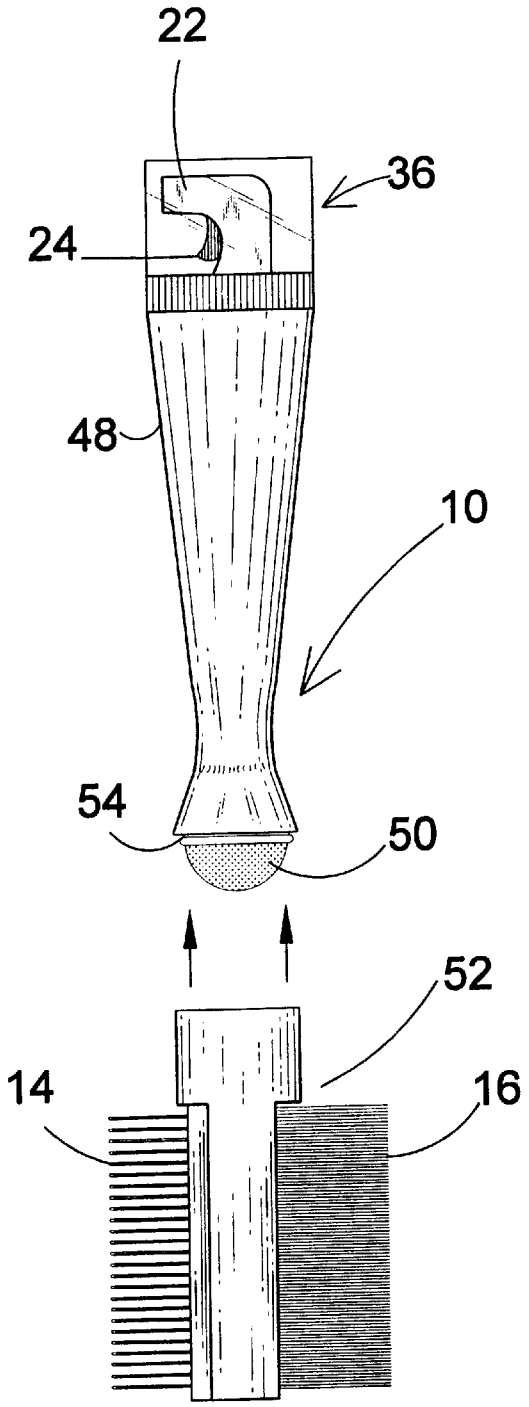
FIG. 7 is a side view of the present invention. Shown is a hairbrush-like device having a comb/hairbrush member and a handle member. The comb/hairbrush member has a comb element and oppositely opposed hairbrush element. The handle member has an applicator on one end and a spray attachment of the other. The spray attachment comprises a spray nozzle and trigger which communicates with a cavity within the handle wherein is stored a quantity of liquid which is applied to the scalp area by means of the spray nozzle trigger. The liquid is worked into the scalp by means of selective use of the applicator and/or comb element and/or brush element.

Turning to FIG. 7, shown therein is a side view of the present invention 10. Shown is a hairbrush-like device 10 having a comb/hairbrush member 52 and a handle member 48. The comb/hairbrush member 52 positioned distally to spray head assembly 36 has a comb element 14 and oppositely positioned hairbrush element 16. The handle member 48 has an applicator 50 on one end and a spray attachment 36 on the other. The spray attachment 36 comprises a spray nozzle 22 and trigger 24 which communicates with a cavity (not shown) within the handle 48 wherein is stored a quantity of liquid which is applied to the scalp area by means of the spray nozzle trigger 24. The liquid is worked into the scalp by means of selective use of the applicator 50 and/or comb element 14 and/or brush element 16. Connection means 54, e.g., being a threaded or a frictional fitting, are provided for attaching handle 48 to member 52.

What is claimed to be new and desired to be protected by Letters Patent is set forth in the appended claims:

I claim:

1. An apparatus for cleaning the head of a baby, comprising:

a) a handle;

b) said handle being contoured for being held by a user;

c) a first cavity contained within said handle;

d) means for a spray head assembly attached to a first end of said handle;

e) a comb disposed on a second end of the apparatus;

f) a hair brush also disposed on said second end of the apparatus;

g) a second cavity contained within said second end of the apparatus;

h) a recessed applicator contained in said second cavity; and i) means for extending said applicator from said second cavity.

2. The apparatus of claim 1, further comprising a storage container wherein the apparatus is stored between uses.

3. The apparatus of claim 1, said first cavity further comprising a liquid useful for cleaning the head of a baby.

4. The apparatus of claim 3, said means for a spray head assembly further comprising a spray nozzle for spraying liquid.

5. The apparatus of claim 4, said means for a spray head assembly further comprising a conduit communicating between said first cavity and said spray nozzle.

6. The apparatus of claim 5, said means for a spray head assembly further comprising a trigger for spraying liquid through said spray nozzle.

7. The apparatus of claim 5, said means for a spray head assembly further comprising a cap.

8. The apparatus of claim 1, said comb disposed oppositely to said hair brush.

9. The apparatus of claim 1, said comb having a plurality of fine teeth.

10. The apparatus of claim 1, said hair brush having a plurality of soft bristles.

11. The apparatus of claim 1, said recessed applicator further comprising an elongated shaft having a ball-like applicator head attached to said shaft, said shaft communicating with a means for being slidably extended disposed on the exterior of said second end of the apparatus, said means for being slidably extended further comprising a slidable switch for manipulation by the user.

12. The apparatus of claim 11, said recessed applicator further comprising an elongated applicator head attached to said shaft.

* * * * *